US005529412A

United States Patent [19]

Jadrich et al.

[11] Patent Number: 5,529,412

[45] Date of Patent: Jun. 25, 1996

[54] PRINT GUIDE MECHANISM

[75] Inventors: Bradley S. Jadrich, Rochester; Mark E. Bridges, Spencerport; Mark A. Harland, Hilton, all of N.Y.

[73] Assignee: Eastman Kodak Company, Rochester, N.Y.

[21] Appl. No.: 289,048

[22] Filed: Aug. 11, 1994

[51] Int. Cl.[6] ..... B41J 11/22

[52] U.S. Cl. ..... 400/357; 400/354; 400/354.1

[58] Field of Search ..... 400/352, 353, 400/354, 354.1, 354.2, 354.3, 355, 357; 358/286

[56] References Cited

U.S. PATENT DOCUMENTS

| | | | |
|---|---|---|---|
| 3,778,121 | 12/1973 | Levesque | 308/6 R |
| 3,790,233 | 2/1974 | Polidor | 308/6 R |
| 3,983,985 | 10/1976 | Guerrini et al. | 400/354.1 |
| 4,025,135 | 5/1977 | Hishida | 308/194 |
| 4,111,293 | 9/1978 | Kockler et al. | 400/208 |
| 4,177,471 | 12/1979 | Mitchell | 346/140 |
| 4,200,402 | 4/1980 | Rix | 400/354 |
| 4,317,137 | 2/1982 | Tompkins | 358/286 |
| 4,445,798 | 5/1984 | Munehiro | 400/320 |
| 4,493,571 | 1/1985 | Potter | 400/144 |
| 4,528,607 | 7/1985 | Thompson | 360/106 |
| 4,648,725 | 3/1987 | Takahashi | 384/9 |
| 4,715,730 | 12/1987 | Magnuson | 384/52 |
| 4,898,487 | 2/1990 | Brull et al. | 400/354 |

FOREIGN PATENT DOCUMENTS

| | | | |
|---|---|---|---|
| 124973 | 6/1987 | Japan | 400/354 |

OTHER PUBLICATIONS

IBM technical disclosure bulletin; vol. 20, No. 2 "Carrier Support Device" Jul. 1977.

*Primary Examiner*—John S. Hilten
*Attorney, Agent, or Firm*—Frank Pincelli

[57] ABSTRACT

A print guide mechanism having parallel first and second guide rods, and a carriage assembly designed to move along the guide rods. The carriage assembly in a preferred embodiment comprises a frame and at least one pair of associated roller bearing assemblies being secured to the frame and being arranged so as to engage the first guide support rod for providing linear movement of the carriage assembly along the first guide rod, at least one upper roller bearing assembly mounted to the frame for engagement with the second guide rod, and a first mounting assembly having at least one lower roller bearing assembly. The at least one upper and lower roller bearing assemblies are arranged so as to engage the second guide rod between. The first mounting assembly is pivotally mounted to the frame so as to compensate for parallel misalignment between the guide rods and is biased for applying a loading force so that positive engagement is provided between the guide rods and the roller bearing assemblies. In the preferred embodiment at least one of the roller bearing assemblies having an outer engaging surface made of a material having a modulus of elasticity less than the modulus of the guide rod which it engages.

31 Claims, 6 Drawing Sheets

14
16
17
22
24
26
28
68
120
122
48
20
19
17
82
83
R1
R2
12
83
80
22
90

PRINT GUIDE MECHANISM

FIELD OF THE INVENTION

The present invention relates to a linear translation carriage used in a printing apparatus for providing smooth and accurate positioning of a printing head. In particular, the present invention is directed to a linear translation carriage used in a light emitting diode (LED) digital printing apparatus.

BACKGROUND OF THE INVENTION

Copending application U.S. Ser. No. 08/123,839 of Douglas A. Smith, John F. Carson, Roy B. Ference and Karen J. Appel, entitled METHOD AND APPARATUS FOR EXPOSING PHOTOSENSITIVE MEDIA WITH MULTIPLE LIGHT SOURCES, filed Sep. 20, 1993, discloses a method and apparatus for exposing photosensitive media with multiple light sources, and which is hereby incorporated by reference. In this patent application, an LED print head is disposed on the outer surface of a spinning rotor which exposes light onto a photosensitive material, such as photographic paper. In such a mechanism there are very stringent performance requirements on the positioning and/or velocity accuracy of the translator mechanism. High accuracy of motion is required to prevent well-known banding artifacts which can be easily perceived by human vision. These artifacts typically can be caused by a variety of positional error sources within the digital printing apparatus. In linear translator-type mechanisms, there are two major components which control the overall accuracy of motion. The first is the driver assembly, which in the case of the copending application is a high-helix, rolled-threaded lead screw driven by a rotary stepper motor. The second major component is the guidance assembly by which the carriage travels linearly along a predetermined path. Typically, the carriage is attached to a pair of parallel shafts by roller elements which allow the carriage to travel along the linear path.

The present invention provides a very accurate and smooth carriage motion for linear translation of the carriage which is relatively low in cost to construct and assemble and minimizes the artifact problems which can arise from such devices.

SUMMARY OF THE INVENTION

In one aspect of the present invention there is provided a print guide mechanism having parallel first and second support guide rods, and a carriage assembly designed to move along the guide rods, the carriage assembly comprising:

a frame;

at least one pair of associated roller bearing assemblies being secured to the frame and being arranged so as to engage the first guide support rod for providing linear movement of the carriage assembly along the first guide rod;

at least one upper roller bearing assembly mounted to the frame for engagement with the second guide rod; and a first mounting assembly having at least one lower roller bearing assembly, the at least one upper and lower roller bearing assemblies being arranged so as to engage the second guide rod therebetween, the first mounting assembly being pivotally mounted to the frame and being biased so as to compensate for parallel misalignment between the guide rods and for applying a loading force so that positive engagement is provided between the guide rods and the roller bearing assemblies.

In accordance with another aspect of the present invention, there is provided a print guide mechanism having parallel first and second support guide rods, and a carriage assembly designed to move along the guide rods, the carriage assembly comprising:

a frame;

a plurality of roller bearing assemblies secured to the frame so that the carriage assembly can travel along the guide rods, at least one of the roller bearing assemblies having an outer engaging surface made of a plastic material having a modulus of elasticity less than the modulus of the guide rod which it engages.

In yet another aspect of the present invention there is provided a print guide mechanism having parallel first and second support guide rods, and a carriage assembly designed to move along the guide rods, the carriage assembly comprising:

a frame;

at least one pair of associated guide rod engaging elements being secured to the frame and being arranged so as to engage the first guide support rod for providing linear movement of the carriage assembly along the first guide rod;

at least one upper guide rod engaging element mounted to the frame for engagement with the second guide rod; and a first mounting assembly having at least one lower guide rod engaging element, the at least one upper and lower guide rod engaging element being arranged so as to engage the second guide rod therebetween, the first mounting assembly being pivotally mounted to the frame and being biased so as to compensate for parallel misalignment between the guide rods and for applying a loading force so that positive engagement is provided between the guide rods and the guide rod engaging elements.

Figure 1:
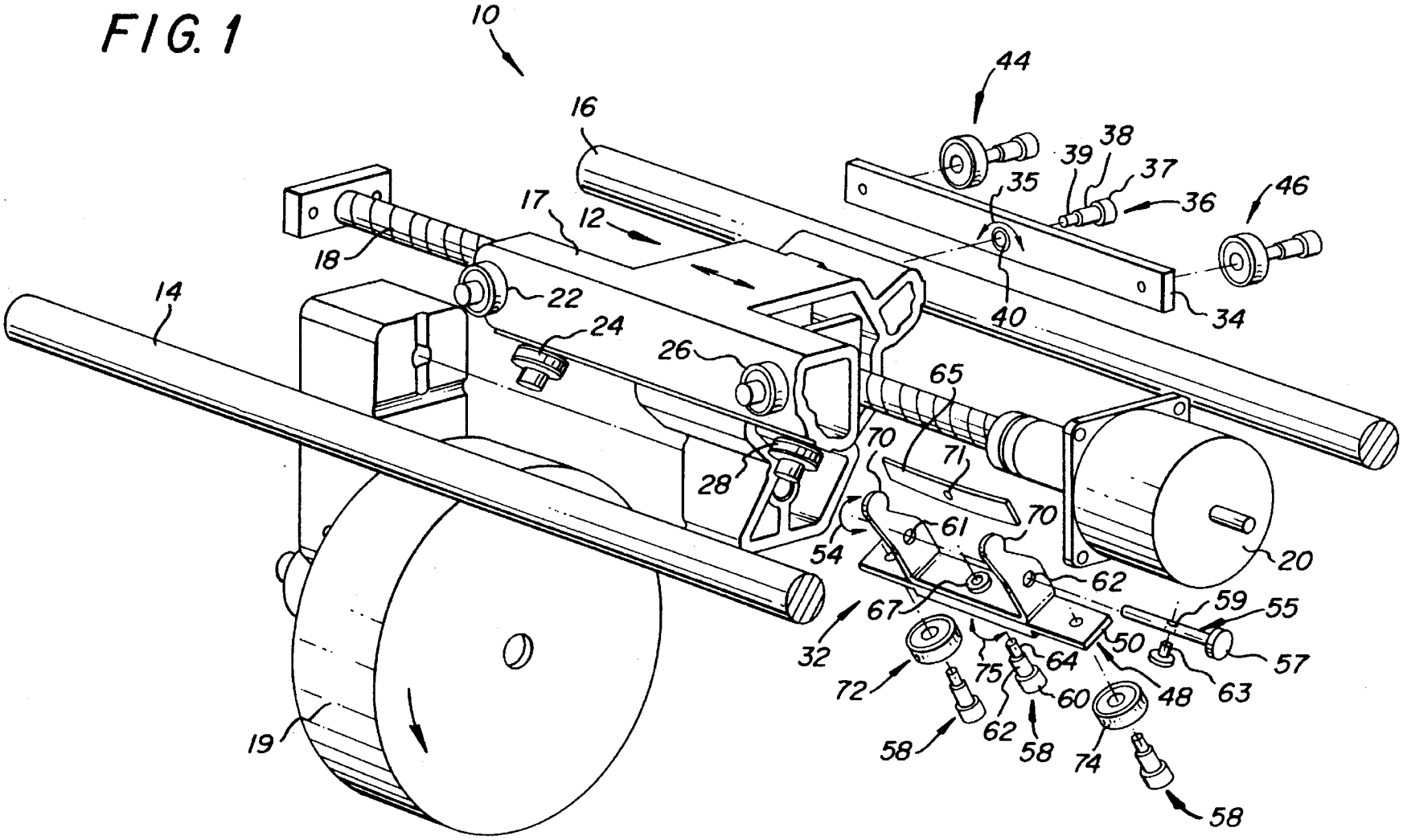
FIG. 1 is an exploded isometric view of a carriage assembly made in accordance with the present invention.
Figure 2:
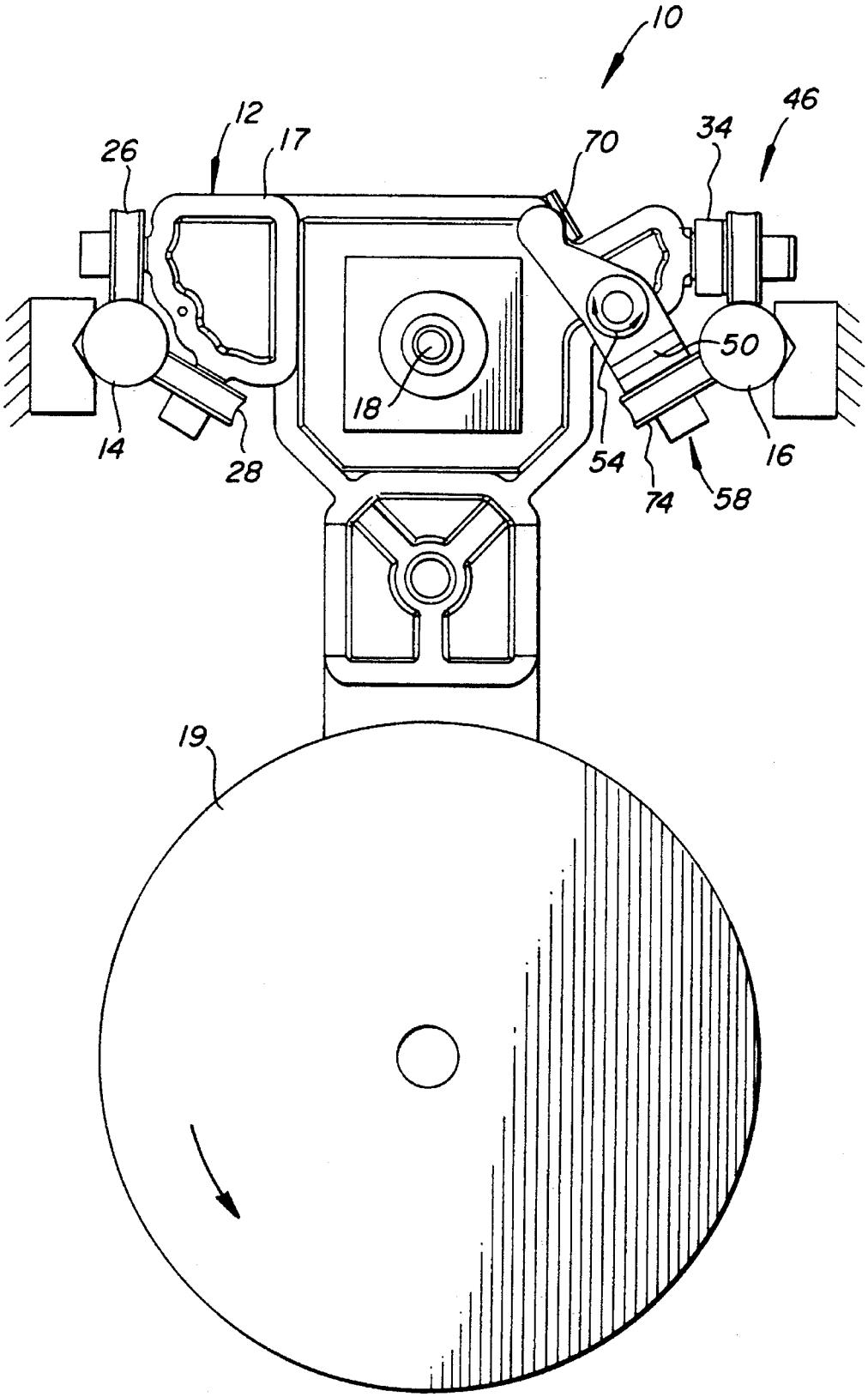
FIG. 2 is an end view of the assembled carriage apparatus of FIG. 1 illustrating how the carriage assembly is constrained against a pair of guide rods.
Figure 3:
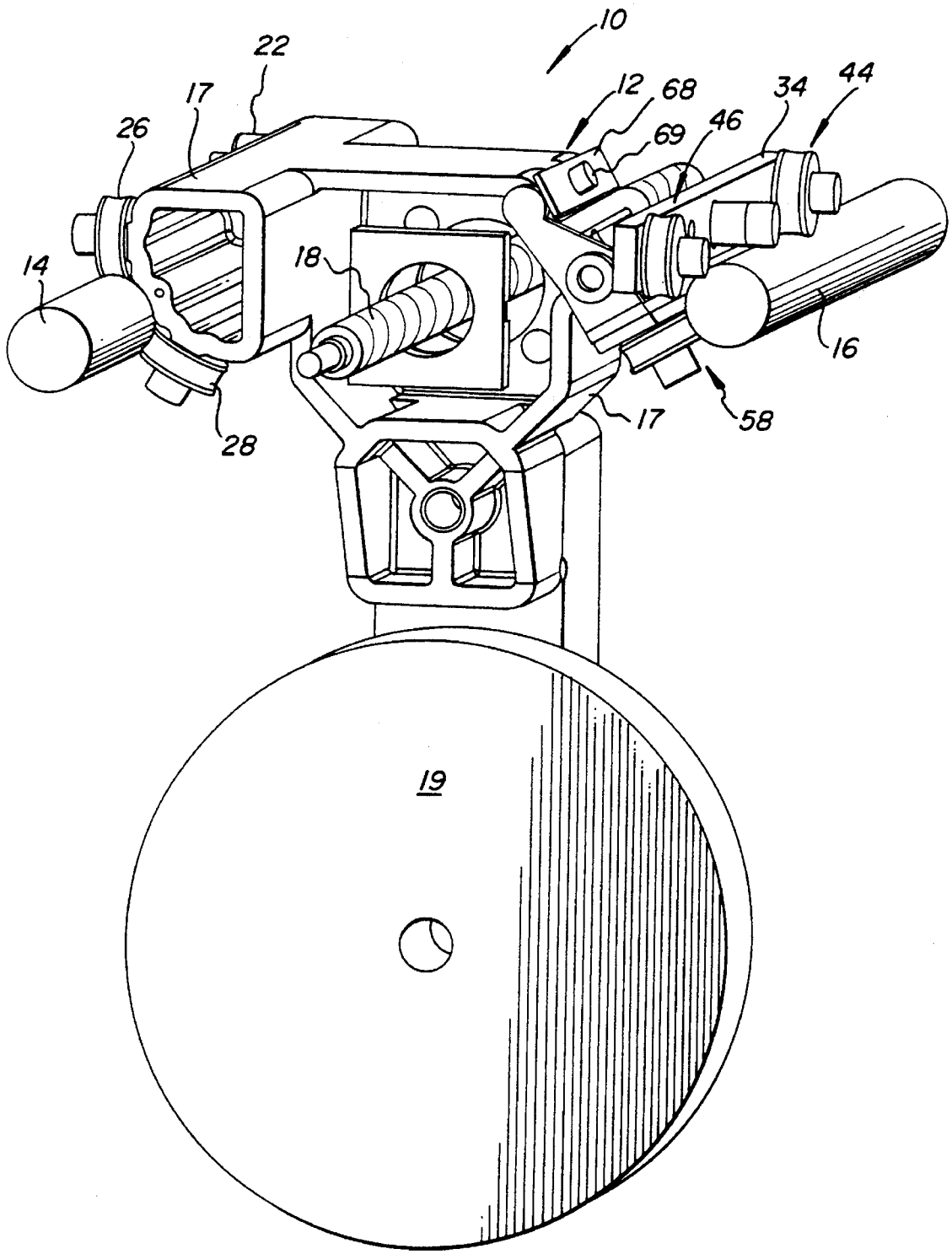
FIG. 3 is a perspective view of the carriage assembly of FIG. 1 as taken from a different direction.
Figure 4:
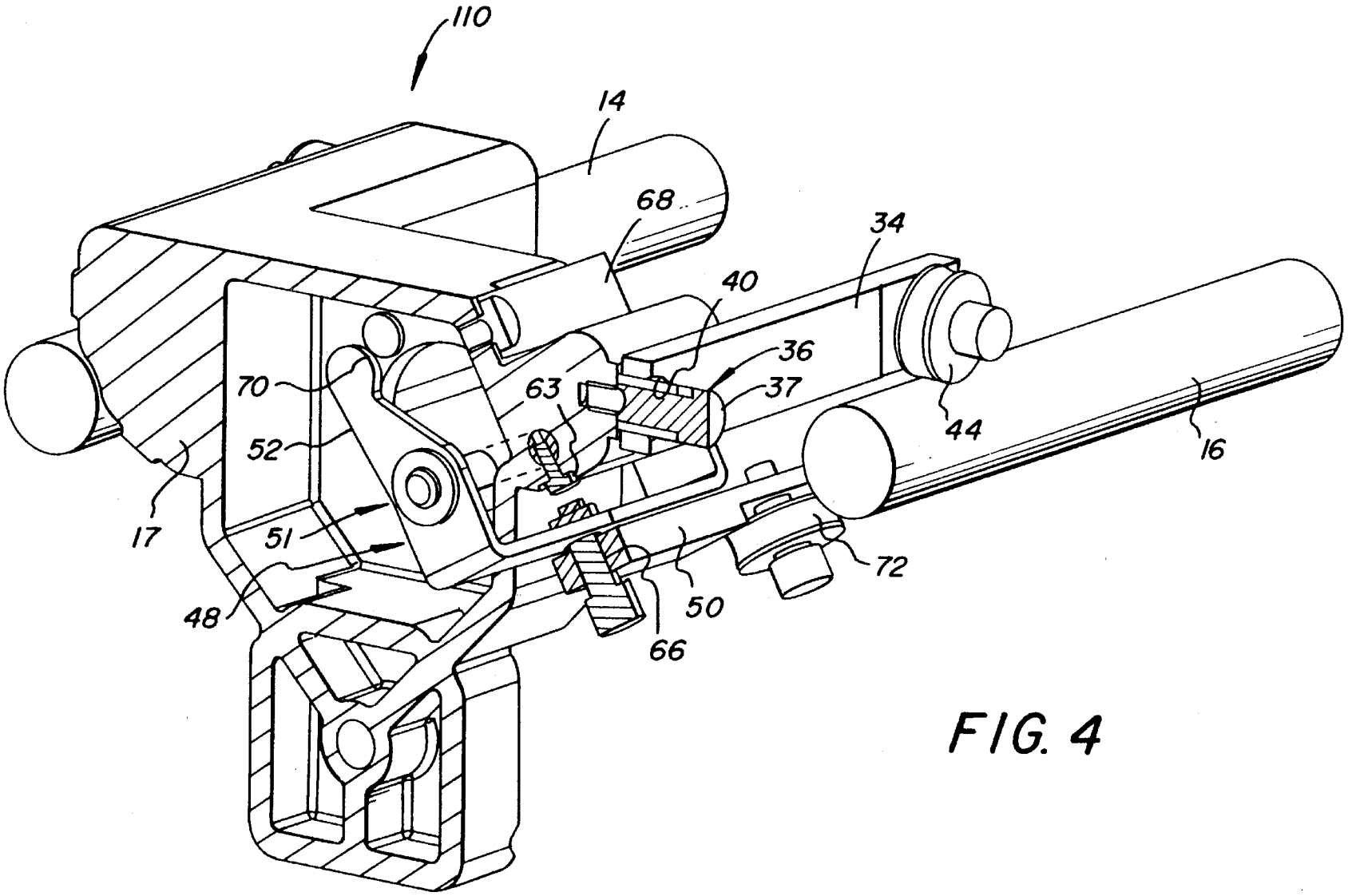
FIG. 4 is an enlarged partial perspective view of FIG. 3 partially broken away so as to illustrate how the lower mounting assembly is mounted to the frame.
Figures 5, 7:
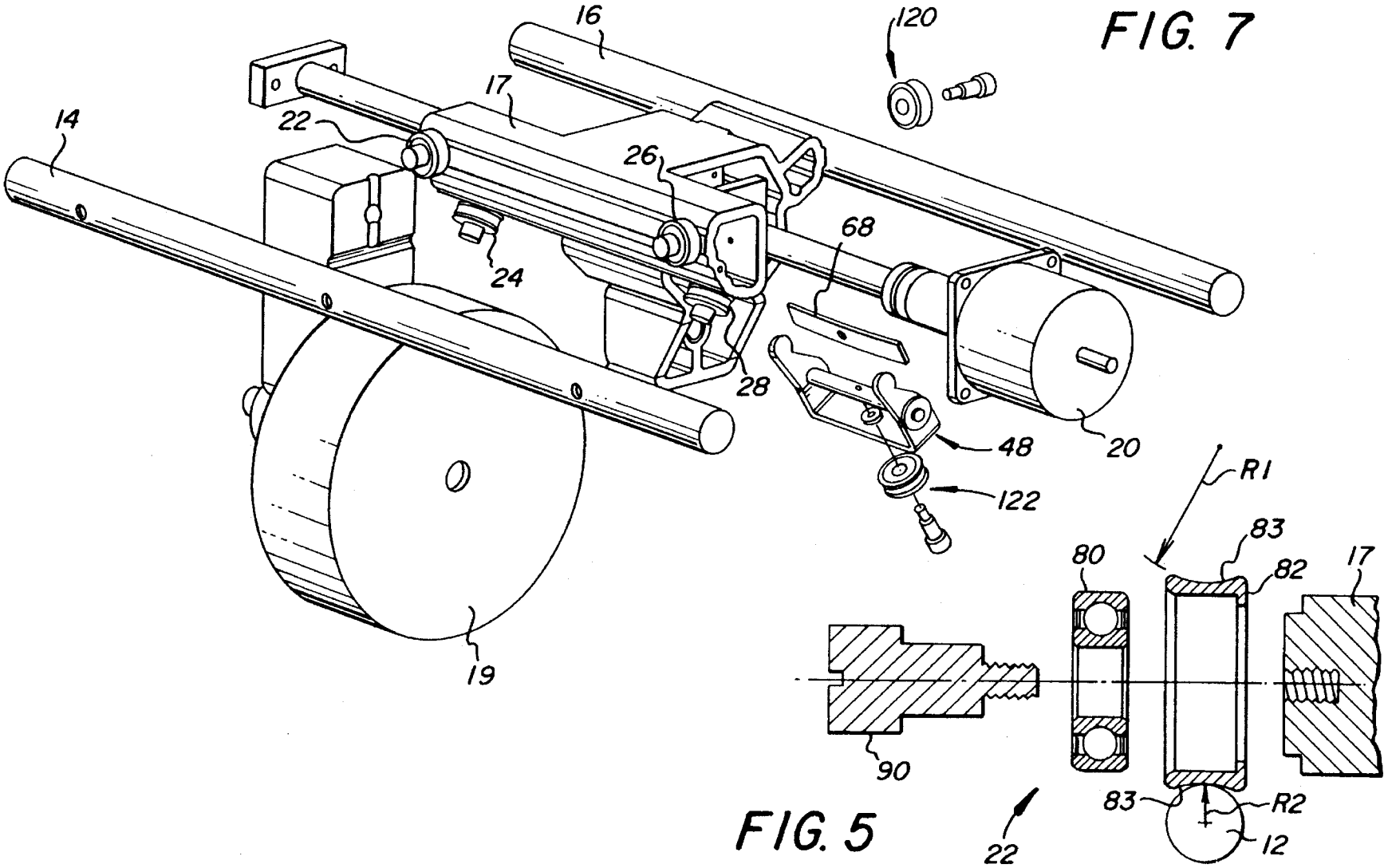
FIG. 5 is an exploded cross-sectional view of a single bearing assembly used in the apparatus of FIG. 1.
Figure 6B:
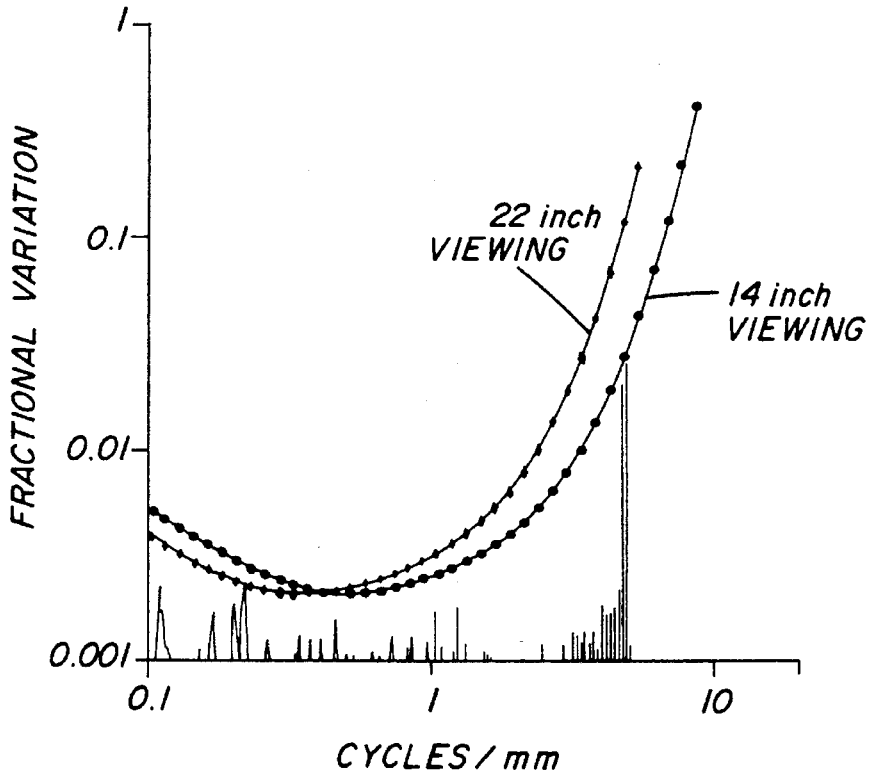
Figure 6A:
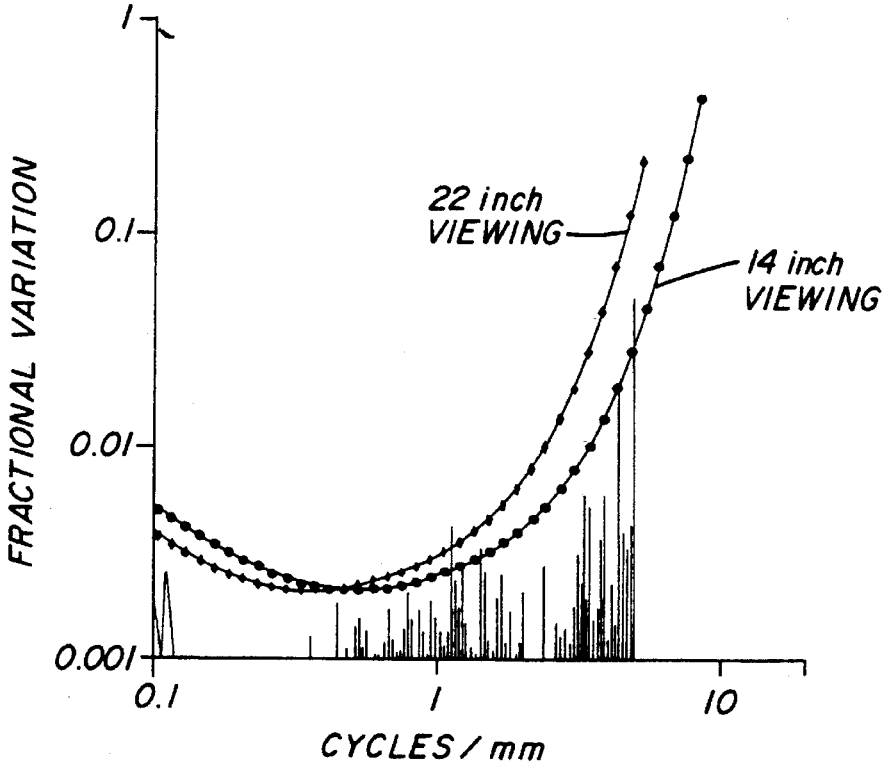

FIG. *6a* illustrates the measured carriage positional error as taken from an carriage assembly having roller bearings made of stainless steel which roll against stainless steel guide rods;

FIG. *6b* illustrates the measured carriage positional error for a composite plastic sleeve roller bearings as applied against stainless steel guide rods; and FIG. 7 is an exploded isometric view of a modified carriage assembly made in accordance with the resent invention;

DETAILED DESCRIPTION OF THE PRESENT INVENTION

Referring to FIGS. 1–4, there is illustrated a print guide mechanism 10 made in accordance with the present invention. The print guide mechanism 10 is specifically useful in a LED print apparatus designed to expose photosensitive material (such as photographic paper) as is described in greater detail in copending application U.S. Ser. No. 08/123,839 of Douglas H. Smith, John F. Carson, Roy B. Ference and Karen J. Appel, entitled METHOD AND APPARATUS FOR EXPOSING PHOTOSENSITIVE MEDIA WITH MULTIPLE LIGHT SOURCES, previously referred to. However, it is to be understood that the guide mechanism can be used in various other printers where a photosensitive material is to be exposed by a print head which traverses the photosensitive material. For example, but not by way of limitation, a laser write head may be used to expose a photosensitive material such as photographic film, photographic paper, thermal media or an electrostatic surface. The mechanism 10 includes a carriage assembly 12 and a pair of parallel guide rods 14,16 upon which the carriage assembly 12 is mounted for linear movement along a path parallel to the axes of the guide rods 14,16. The carriage assembly 12 includes a frame 17 and is mounted to guide rods 14,16 in such a way that motion of the carriage assembly 12 is allowed in only a single degree of freedom, which is in the direction parallel to the guide rods 14,16. Translation of the carriage assembly 12 along the guide rods 14,16 may be accomplished by any desired mechanism. In the particular embodiment illustrated, there is provided a lead screw 18 and stepper motor 20 which are mounted to the print apparatus (not shown) in which the print guide mechanism 10 is to be used. The lead screw 18 engages the carriage assembly 12 in such a manner that rotation of the lead screw 18 will cause the carriage assembly 12 to move along the guide rods 14,16. In the embodiment illustrated, a rotating print head 19 is provided for printing of a photosensitive material and, in particular, photographic paper or film which is later processed in well-known conventional processors. However, the carriage assembly 12 may carry any desired type print mechanism which is used to traverse the photosensitive media. The lead screw 18 may be mounted to the apparatus in any known conventional manner. Preferably, the lead screw is mounted to the carriage assembly 12 such that substantially constant linear speed and/or accurate positioning is imparted to the carriage assembly 12. A suitable example of how the lead screw may be engaged to the drive mechanism is described in copending application U.S. Ser. No. 08/123,838 of Bradley S. Jadrich and Mark E. Bridges, entitled LEAD SCREW COUPLER, filed Sep. 20, 1993, which is hereby incorporated by reference. It is, of course, understood that any other desired coupling mechanism may be provided that is capable of transferring the rotation movement of the lead screw to translation movement of the carriage assembly 12 along the guide rods 14,16.

The carriage assembly 12 is mounted to guide rod 12 by a plurality of roller bearing assemblies 22,24,26,28. The roller bearings 22,24,26,28 are positioned such that roller bearings 22,24 are located at a first location and are spaced apart on the carriage such that guide rod 14 is captured therebetween. Likewise, roller bearing assemblies 26,28 are secured to the carriage at a second location spaced from the first location and are positioned on the frame 17 so as to also capture the guide rod 14 therebetween. The roller bearing assemblies 22,24,26,28 engage the guide rod 14 so as to provide linear movement of the carriage 12 assembly along the guide rod 14.

The carriage assembly 12 is also mounted to guide rod 16 by mounting assemblies 30,32. Mounting assembly 30 includes a mounting member 34 which is secured to frame 17 such that the mounting member 34 may pivot about an axis substantially perpendicular to the guide rod 14 as illustrated by arrow 35. In the particular embodiment illustrated, the mounting member 34 is secured by a mounting pin 36 having a head 37, a shank portion 38 adjacent head 37 and threaded end 39. The shank portion 38 and threaded end 39 pass through an opening 40 provided in mounting member 34. The shank portion 38 is sized so as to allow mounting member 34 to pivot about mounting pin 36 and threaded end 39 is sized so as to engage a thread opening (not shown) in frame 17 for securing mounting assembly 30 to frame 17. The mounting member 34 is further provided with a pair of spaced upper roller bearing assemblies 44,46 for contacting of guide rod 16 and for supporting frame 17 thereon.

The mounting assembly 32 is secured to frame 17 and includes a support frame 48 having a mounting member 50 and a U-shaped member 51 having a base section 52 and a pair of upstanding projections 53. The mounting assembly 32 is mounted to frame 17 such that there is provided pivotal movement about an axis substantially parallel to the direction of travel of the carriage assembly 12 as indicated by arrow 54. For this purpose there is provided a mounting pin 55 having a shank portion 57 which passes through a pair of aligned openings 61 in projections 53. The pin 55 also has an opening 59 through which a mounting pin 63 passes and secures support frame 48 to the frame 17. The mounting pin 63 may be secured to frame 17 in any desired manner.

The U-shaped member 51 is pivotally mounted to mounting member 50 so as to allow movement of the member 50 in a direction substantially perpendicular to the direction of travel of the carriage assembly 12. The member 51 is secured to mounting member 50 by a mounting pin 58 having a head 60, a shank section 62 and a threaded end 64. The shank section 62 is designed to pass through an opening 66 in mounting member 50 such that the threaded end 64 will engage a threaded opening 67 in member 51 (see FIG. 4). A flexure member 68 is secured to frame 17 by mounting pin 69 which extends through an opening 71 in member 68 and engages a threaded opening (not shown) in frame 17. Flexure member 68 is designed to engage a bearing surface 70 associated with each of the projections 52. Flexure member 68 acts like a spring so as to apply a biasing force against bearing surfaces 70 such that the support frame 48 may pivot in the direction indicated by arrow 75. A pair of lower roller bearing assemblies 72,74 are secured at the lateral ends of the support member 50. The mounting assemblies 30,32 are positioned such that the guide rod 16 is captured between the roller bearing assemblies 44,46,72,74 and allows the carriage assembly 12 to move along the guide rod 16. As can be seen, the mounting assemblies 30,32 are allowed to pivot in directions as indicated by arrows 35,75, respectively, so as to engage against guide rod 16 in such a manner so as to compensate for parallel misalignment of the guide rods 14,16. Since the flexure member 68 is secured to frame 17, flexure member 68 applies a loading force to associated roller bearing assemblies 72,74 so as to apply a force against guide rod 16 which in turn provides positive engagement of the remaining roller bearing assemblies against their respective guide rod.

The roller bearing assemblies 22,24,26,28,44,46,72,74 are each mounted to their respective members. Referring to FIG. 5, there is illustrated in detail the construction of a roller bearing assembly 22 made in accordance with the present invention and which is representative of the construction of the remaining roller bearing assemblies 24,26, 28,44,46,72,74. In particular, roller bearing 22 includes an inner radial bearing 80 which is secured to an outer sleeve 82. In the preferred embodiment, the outer sleeve 82 is made of a composite plastic material and has an outer engaging surface 83. The material of the sleeve 82 preferably has a modulus of elasticity substantially less than the modulus of elasticity of the guide rod on which it is in contact. The plastic material of sleeve 82 was selected for its relatively high elastic modulus for a plastic material, which is preferably at least $0.7\times10^6$ psi. However, a variety of other composites or filled thermoplastics which have a similar high elastic modulus would be suitable for the present invention. A high elastic modulus is desired for the sleeve in order to minimize the amount of deflection and/or creep to the plastic sleeve when loaded in compression against its respective guide rod. In the preferred embodiment illustrated, the guide rods 14,16 are each made of stainless steel having a modulus of elasticity of approximately $28.0\times10^6$ psi, whereas the outer sleeve of each of the roller bearing assemblies would be made out of a composite plastic material. In the particular embodiment illustrated, the sleeve is made of 6/6 nylon with 20% carbon fibers having a modulus of elasticity of about $2.4\times10^6$ psi. The plastic material should not be made of a material which has a modulus of elasticity too close to the rods which they contact. Preferably, the modulus of elasticity of the plastic material is not greater than about 10% of the guide rod which it contacts. Thus, in the embodiment illustrated, the modulus of elasticity of the sleeve 82 is not greater than about $2.8\times10^6$ psi.

It is to be understood that the roller bearing assemblies may be mounted to the frame 17 or mounting assemblies 30,32 in any desired manner. In the preferred embodiment illustrated, a threaded shoulder screw 90 is used for mounting of the roller bearing assemblies to their respective mounting members.

An important aspect of the present invention is that the plastic sleeve 82 of the roller bearing assembly, which is in rolling contact with the guide rod, provides a level of damping and smoothness to the carriage. Roller bearing assemblies having stainless steel outer sleeves were initially evaluated for use with the carriage assembly. It was discovered that when stainless steel roller bearing assemblies were utilized with stainless steel guide rods, the performance with regard to the linear positioning accuracy of the carriage assembly was substantially inferior to the linear positioning accuracy of the carriage assembly when roller bearing assemblies having plastic sleeves were provided and used against stainless steel guide rods.

Referring to FIG. *6a* and *6b*, there is illustrated a comparison of translation performance between a carriage assembly having stainless steel roller bearing assemblies and a carriage assembly having plastic bearing assemblies when each carriage assembly was used with stainless steel guide rods. In particular, FIG. *6a* illustrates the use of stainless steel bearing assemblies against stainless steel guide rods and FIG. *6b* illustrates use of plastic bearing assemblies against stainless steel rods. The plots illustrated in FIGS. *6a* and *6b* were generated by computing the fourier transform of carriage positional error as measured with a laser interferometer. The stainless steel rods and stainless steel bearing assemblies had a modulus of elasticity of about $28\times10^6$ psi. The plastic bearing assemblies had an outer sleeve made of a 17% Kevlar filled 6/6 nylon plastic (purchased from A. L. Hyde Co. under the tradename "Hydlar Z"), the filled nylon plastic had a modulus of elasticity of about $0.9\times10^6$ psi. As illustrated by the vertical lines in FIG. *6a*, there was a substantial amount of position variation as compared to the use of plastic roller bearing assemblies as applied against the guide rods. In the stainless steel roller bearings, there was substantial amounts of undesirable spectral energy between 0.5–4.0 cycle/mm which is not present when the composite plastic sleeves roller bearing assemblies were used as shown in FIG. *6b*. This illustrates a smoothness or attenuation in which the plastic sleeve roller bearing assemblies adds to the translation performance of the carriage. It should be noted that the surface finish (i.e. the roughness) of the contacting surface of the plastic sleeve should be kept to a minimum in order to achieve optimal performance. Preferably the surface roughness of both the plastic and stainless steel roller bearings is less than about 32 micro inches. Also, the radial runout of the roller gearing assemblies should also be held to a minimum in order to obtain optimal performance. Preferably the radial runout is less than about 0.0005 inches.

In order to keep or minimize the point contact stresses between the roller bearing assemblies and the guide rods, the shape and configuration of the surface 83 should be appropriately matched with respect to the guide rod with which it engages. This matching is illustrated by reference to FIG. 5. The radius R1 of the surface 83 should be equal to or slightly larger than the radius R2 of the outer surface of the guide rods. While R1 and R2 could be identical, it is preferable that R1 be slightly larger in order to compensate for product tolerance variations. Preferably, R1 is in the range of about 101 to 110% of R2. In the embodiment illustrated, R1 is about 103% of R2. Since the outer sleeve of the bearings has a lower modulus of elasticity as compared to the steel rods, the plastic sleeves 82 will compress more than the stainless steel, distributing the load over a larger concave area, and thus reducing the contact stress between the guide rod and the plastic sleeve. In using the configuration set forth in the present invention, there was no visual indication of wear on the guide rods or plastic sleeve surfaces after one million inches of carriage travel. This was in stark contrast to the substantial wear or brinelling on the guide rods and bearing surfaces, as indicated by visual inspection, when stainless steel roller bearing assemblies were used with stainless steel guide rods after only 200,000 inches of travel.

Referring to FIG. 7, there is illustrated a modified guide mechanism 110 made in accordance with the present invention. The mechanism 110 is similar to guide mechanism 10, like numerals indicating like parts. In mechanism 110 there is provided only a single roller bearing assembly associated with each of the mounting assemblies 30,32. The mounting assembly 32 still provides the means for allowing compensation of parallel misalignment between the guide rods 14,16 and for applying a biasing force against guide rod 16 which provides for positive engagement of all the roller bearing assemblies. However, this embodiment has the disadvantage with respect to the previous embodiment in that increased contact force are applied to each of the roller bearing assemblies 120,122. This becomes important when the weight of the carriage becomes significant. The use of more than one roller bearing assembly with each of the mounting assemblies 30,32, as illustrated in the embodiment of FIGS. 1–4, allows use of greater weight carriages. Allowing pivoting of mounting assemblies 30, 32, in the directions indicated by arrows 40 and 75 minimizes or avoids any problem associated with using spaced roller bearing assemblies.

While in the preferred embodiment roller bearing assemblies are utilized to mount the frame to the guide rods, it is contemplated that other type guide rod engaging elements, such as friction pads, can be substituted for one or more of the roller bearing assemblies for slideably mounting the frame to the guide rods. Use of such friction pads will provide a dampening affect which is beneficial in the incremental motion of the carriage along the guide rods as is described in the preferred embodiment. For example, friction pads made of 6/6 nylon material having 17% Kevlar fibers may be used in place on one or more of the roller bearing assemblies.

Applicants have provided an assembly which provides smooth and accurate position of a carriage while also providing long service life.

It is to be understood that various other changes and modifications may be made without departing from the scope of the present invention, the present invention being limited by the following claims.

PARTS LIST

10 . . . print guide mechanism
12 . . . carriage assembly
14,16 . . . guide rods
15,50 . . . support member
17 . . . frame
18 . . . lead screw
20 . . . stepper motor
22,24,26,28,44,46,72,74,120,122 . . . roller bearing assemblies
30,32 . . . mounting assemblies
34 . . . mounting member
35,54,75 . . . arrow
36,55,58,63 . . . mounting pin
37 . . . head
38,57 . . . shank portion
39 . . . end
40,59,66,71 . . . opening
48 . . . support frame
50 . . . mounting member
51 . . . U-shaped member
52 . . . base section
53 . . . upstanding projections
60 . . . head
61 . . . aligned openings
62 . . . shank section
64 . . . threaded end
67 . . . opening
68 . . . flexure member
70 . . . bearing surface
80 . . . radial bearing
82,87 . . . sleeve
83 . . . outer engaging surface
90 . . . threaded shoulder screw
110 . . . modified guide mechanism

We claim:

1. A print guide mechanism comprising:

parallel first and second support guide rods;

a carriage assembly designed to move along said guide rods;

a frame;

at least one pair of associated roller bearing assemblies being secured to said frame and being arranged so as to engage said first guide support rod for providing linear movement of said carriage assembly along said first guide rod;

at least one upper roller bearing assembly mounted to said frame for engagement with said second guide rod; and a first mounting assembly having at least one lower roller bearing assembly, said at least one upper and lower roller bearing assemblies being arranged so as to engage said second guide rod therebetween, said first mounting assembly being pivotally mounted to said frame and being biased so as to compensate for parallel misalignment between said guide rods and for applying a loading force so that positive engagement is provided between said guide rods and said roller bearing assemblies, wherein at least one of said roller bearing assemblies having an outer surface made of a plastic material having a modulus of elasticity greater or equal to $0.7\times10^6$ psi, said modulus of elasticity of said at least one roller bearing being not greater than about 10% of the modulus of the guide rod which it contacts.

2. A print guide mechanism according to claim 1 wherein a spring member is provided for biasing the first mounting member.

3. A print guide mechanism according to claim 1 wherein said outer sleeve is made of 6/6 nylon with 17% Kevlar fibers having a modulus of about $0.9\times10^6$ psi.

4. A print guide mechanism according to claim 1 wherein at least one of said roller bearing assemblies include an outer sleeve having an arcuate mating surface of a first radius which is greater than the cross-sectional radius of the guide rod which it engages.

5. A print guide mechanism according to claim 4 wherein the cross-sectional radius of said arcuate mating surface of said outer sleeve is equal to or greater than said first radius of guide rod.

6. A print guide mechanism according to claim 5 wherein the radius of said arcuate mating surface of said outer sleeve is about 103% of said second radius of said guide rod.

7. A print guide mechanism according to claim 1 wherein a second mounting assembly is provided for mounting said at least one upper roller bearing assembly.

8. A print guide mechanism according to claim 7 wherein there is provided two upper roller bearing assemblies, said second mounting assembly being rotatably mounted to said frame so as to allow substantially equal distribution of load between the two upper roller bearing assemblies.

9. A print guide mechanism according to claim 1 wherein there is provided two lower roller bearing assemblies, said two lower roller bearing assemblies being mounted to said first mounting member so as to allow substantially equal loading of the bearings against the second guide rod.

10. A print guide mechanism according to claim 9 wherein said first mounting member comprises a substantially U-shaped member, a support member secured to said U-shaped member having a pair of upstanding projections, said U-shaped member and said support member being secured together so as to allow rotation there between, and a flexure member secured to said frame, said flexure member contacting said projections so as to provide said biasing of said first mounting member, said two lower roller bearing members being secured to said support member.

11. A print guide mechanism according to claim 1 wherein said first mounting member comprises a substantially U-shaped member, a support member secured to said U-shaped member having a pair of upstanding projections, and a flexure member secured to said frame, said flexure member contacting said projections so as to provide said biasing of said first mounting member.

12. A print guide mechanism comprising:

parallel first and second support guide rods;

a carriage assembly designed to move along said guide rods;

a frame;

a plurality of roller bearing assemblies secured to said frame so that said carriage assembly can travel along said guide rods, at least one of said roller bearing assemblies having an outer engaging surface made of a plastic material having a modulus of elasticity less than the modulus of the guide rod which it engages, wherein at least one of said roller bearing assemblies having an outer surface made of plastic material having a modulus of elasticity greater or equal to $0.7\times10^6$ psi, said modulus of elasticity of said at least one roller bearing being not greater than about 10% of the modulus of the guide rod which it contacts.

13. A print guide mechanism according to claim 12 wherein said plurality of roller bearing assemblies comprising;

a first pair of associated roller bearing assemblies;

a second pair of associated roller bearing assemblies axially spaced from said first pair of roller bearing assemblies, said first and second pair of roller bearing assemblies being secured to said frame and being arranged so as to engage said first guide support rod for providing linear movement of said carriage assembly along said first guide rod;

at least one upper roller bearing assembly mounted to said frame for engagement with said second guide rod; and a first mounting assembly having at least one lower roller bearing assembly, said at least one upper and lower roller bearing assemblies being arranged so as to engage said second guide rod between, said first mounting assembly being pivotally mounted to said frame and being biased so as to compensate for parallel misalignment between said guide rods and for applying a loading force so that positive engagement is provided between said guide rods and said roller bearing assemblies.

14. A print guide mechanism according to claim 13 wherein said guide rods are each made of a material having a modulus of about $28.0\times10^6$ pounds per square inch and said outer surface of said roller bearing assemblies being made of material having a modulus of elasticity less than about $2.8\times10^6$ psi.

15. A print guide mechanism according to claim 14 wherein the radius of outer engaging surface of said outer sleeve is about 103% of said first radius of said guide rod.

16. A print guide mechanism according to claim 12 wherein the outer engaging surface of said roller bearing assemblies are made of a material having a modulus of elasticity no greater than about 10% of the modulus of elasticity of the material from which the guide rods are made.

17. A print guide mechanism according to claim 16 wherein said outer sleeve is made of 6/6 nylon with 17% Kevlar fiber having a modulus of about $0.9\times10^6$ psi.

18. A print guide mechanism according to claim 12 wherein the outer engaging surface of at least one roller bearing assembly is made of a material having a modulus of elasticity in the range of about $0.7\times10^6$ psi to about $3.0\times10^6$ psi.

19. A print guide mechanism according to claim 12 wherein at least one of said roller bearing assemblies include an outer sleeve having an arcuate mating surface of a first radius which is greater than the cross-sectional radius of the guide rod which it engages.

20. A print guide mechanism according to claim 12 wherein the cross-sectional radius of said outer engaging surface of said outer sleeve is equal to or greater than the radius of said guide rod.

21. A printer having a movable carriage assembly for moving a print head for writing on a photosensitive material, said printer comprising:

parallel first and second support guide rods;

a carriage assembly designed to move along said guide rods, said carriage assembly having a frame, at least one pair of associated roller bearing assemblies being secured to said frame and being arranged so as to engage said first guide support rod for providing linear movement of said carriage assembly along said first guide rod, at least one upper roller bearing assembly mounted to said frame for engagement with said second guide rod, and a first mounting assembly having at least one lower roller bearing assembly, said at least one upper and lower roller bearing assemblies being arranged so as to engage said second guide rod therebetween, said first mounting assembly being pivotally mounted to said frame and being biased so as to compensate for parallel misalignment between said guide rods and for applying a loading force so that positive engagement is provided between said guide rods and said roller bearing assemblies, wherein at least one of said roller bearing assemblies having an outer surface made of a plastic material having a modulus of elasticity greater or equal to $0.7\times10^6$ psi, said modulus of elasticity of said at least one roller bearing being not greater than about 10% of the modulus of the guide rod which it contacts.

22. A printer according to claim 21 wherein at least one of said roller bearing assemblies include an outer sleeve having an arcuate mating surface of a first radius which is greater than the cross-sectional radius of the guide rod which it engages.

23. A printer according to claim 22 wherein the cross-sectional radius of said arcuate mating surface of said outer sleeve is greater to or equal to 101% of said first radius of said guide rod.

24. A printer according to claim 21 wherein said print head comprises at least one light emitting diode.

25. A printer according to claim 21 wherein said photosensitive material comprises photographic paper.

26. A printer according to claim 24 wherein the cross-sectional radius of said arcuate mating surface of said outer sleeve is greater to or equal to 103% of said first radius of said guide rod.

27. A printer according to claim 21 wherein said outer sleeve is made of 6/6 nylon with 17% Kevlar fibers having a modulus of about $0.9\times10^6$ psi.

28. A print guide mechanism comprising:

parallel first and second support guide rods;

a carriage assembly designed to move along said guide rods;

a frame;

at least one pair of associated guide rod engaging elements being secured to said frame and being arranged so as to engage said first guide support rod for providing linear movement of said carriage assembly along said first guide rod;

at least one upper guide rod engaging element mounted to said frame for engagement with said second guide rod; and a first mounting assembly having at least one lower guide rod engaging element, said at least one upper and lower guide rod engaging element being arranged so as to engage said second guide rod therebetween, said first mounting assembly being pivotally mounted to said frame and being biased so as to compensate for parallel misalignment between said guide rods and for applying a loading force so that positive engagement is provided between said guide rods and said guide rod engaging elements, wherein at least one of said roller bearing assemblies having an outer surface made of a plastic material having a modulus of elasticity greater or equal to $0.7\times10^6$ psi, said modulus of elasticity of said at least one roller bearing being not greater than about 10% of the modulus of the guide rod which it contact.

29. A print guide mechanism according to claim 28 wherein at least one of said guide rod engaging elements comprises a friction pad.

30. A print guide mechanism according to claim 29 wherein said pad is made of 6/6 nylon having reinforcing fibers.

31. A print guide mechanism according to claim 28 wherein at least one of said guide rod engaging elements comprises a roller bearing assembly.

* * * * *